US012714928B2

(12) United States Patent
Wilbur et al.

(10) Patent No.: US 12,714,928 B2
(45) Date of Patent: Aug. 25, 2026

(54) GOLF PRACTICE SYSTEM

(71) Applicant: Eighteen Heights Holdings, LLC, Kaysville, UT (US)

(72) Inventors: Alan Wilbur, Bountiful, UT (US); Andrew Bergeson, Gilbert, AZ (US); Chris Cahoon, Bountiful, UT (US); Anthony Bergeson, Kaysville, UT (US)

(73) Assignee: EIGHTEEN HEIGHTS HOLDINGS, LLC, Kaysville, UT (US)

( * ) Notice: Subject to any disclaimer, the term of this patent is extended or adjusted under 35 U.S.C. 154(b) by 0 days.

(21) Appl. No.: 19/409,494

(22) Filed: Dec. 4, 2025

(65) Prior Publication Data

US 2026/0151683 A1 Jun. 4, 2026

Related U.S. Application Data

(60) Provisional application No. 63/728,078, filed on Dec. 4, 2024.

(51) Int. Cl.
*A63B 69/36* (2006.01)
*A63B 63/00* (2006.01)
*A63B 71/02* (2006.01)

(52) U.S. Cl.
CPC ..... *A63B 69/36* (2013.01); *A63B 71/022* (2013.01); *A63B 2063/006* (2013.01); *A63B 2210/50* (2013.01); *A63B 2210/58* (2013.01)

(58) Field of Classification Search
CPC . A63B 69/36; A63B 71/022; A63B 2063/006; A63B 2210/50; A63B 2210/58
See application file for complete search history.

(56) References Cited

U.S. PATENT DOCUMENTS

| | | | | |
|---|---|---|---|---|
| 5,116,056 | A * | 5/1992 | Schmutte | A63B 71/022 473/421 |
| 5,205,564 | A * | 4/1993 | Lamberti | A63B 63/004 473/421 |
| 6,283,876 | B1 * | 9/2001 | Northcutt | A63B 69/0002 473/422 |
| 6,482,112 | B1 * | 11/2002 | Betz | A63B 71/022 473/421 |
| 6,485,373 | B1 * | 11/2002 | Stephens | A63B 71/022 473/197 |
| 7,118,487 | B2 | 10/2006 | Turcot | |
| 7,963,865 | B2 | 6/2011 | Rigoli | |
| 9,770,640 | B1 | 9/2017 | Kurz | |
| 10,080,948 | B2 | 9/2018 | Manieri | |
| 10,857,444 | B1 | 12/2020 | Holden | |
| 10,898,783 | B1 | 1/2021 | Snowder | |

(Continued)

*Primary Examiner* — Audrey B. Walter
(74) *Attorney, Agent, or Firm* — Massey Bean & Lewis

(57) ABSTRACT

A golf practice system includes a first strap extendable, in tension, from a first anchor point to a second anchor point. The golf practice system also includes a second strap extendable, in tension, from a third anchor point to a fourth anchor point such that at least a portion of the second strap is parallel to and offset from at least a portion of the first strap. The golf practice system further includes a net system comprising an impact screen, a top netting, a first side netting, and a second side netting. The impact screen is collapsible, suspendable from the first strap, and slidable along the first strap. The top netting is collapsible, suspendable from the second strap, and slidable along the second strap.

20 Claims, 13 Drawing Sheets

(56) References Cited

U.S. PATENT DOCUMENTS

| | | | | |
|---|---|---|---|---|
| 11,806,598 | B2 | 11/2023 | Mann | |
| 11,857,856 | B2 | 1/2024 | Kapsalis | |
| 2012/0322567 | A1* | 12/2012 | Manieri | A63B 71/022 473/197 |
| 2016/0375332 | A1* | 12/2016 | Edwards | A63B 63/004 473/476 |
| 2022/0105413 | A1 | 4/2022 | Shi | |
| 2022/0409976 | A1 | 12/2022 | Gao | |
| 2023/0076144 | A1 | 3/2023 | Gao | |
| 2023/0191218 | A1 | 6/2023 | Alvarez | |
| 2024/0252906 | A1 | 8/2024 | De Spong | |
| 2025/0177835 | A1* | 6/2025 | Hemminger | A63B 71/022 |

* cited by examiner

GOLF PRACTICE SYSTEM

CROSS-REFERENCE TO RELATED APPLICATION

This application claims the benefit of U.S. Provisional Patent Application No. 63/728,078, filed Dec. 4, 2024, which is incorporated herein by reference in its entirety.

FIELD

This disclosure relates generally to golf equipment and more particularly to golf practice equipment having a net system suspendable from overhead straps.

BACKGROUND

Some golf practice equipment includes an impact screen and netting that are self-supporting and modular by relying on a flexible frame to shape the impact screen and netting. Such self-supporting modular systems are easy to set up, take down, and transport from location to location. However, these types of systems are generally unsturdy, fragile, and unsuitable for sophisticated golf simulation systems.

Many sophisticated golf simulation systems include netting, padding, or screens permanently built into a floor, walls and/or a ceiling of a room. Although these sophisticated golf simulation systems provide exceptional performance, because they are permanently fixed in place within a room, use of the room for other purposes is limited. Some golf practice manufacturers have attempted to provide golf practice systems that are more permanently anchored to a room, to provide more robust performance associated with sophisticated golf simulation systems, but configured to enable other uses of the room. Although beneficial in some respects, these golf practice systems require complicated assembly and anchoring to pre-existing fixtures of a room, such as components of a garage door opening system in a garage.

SUMMARY

The subject matter of the present application has been developed in response to the present state of the art, and in particular, in response to the shortcomings of conventional golf practice systems, which have not yet been fully solved by currently available techniques. Golf practice systems, as defined herein, include an impact screen, side netting, a top netting, and a mat. A golfer hits golf balls off the mat and into the impact screen. The side netting and the top netting help to capture errant golf balls. The subject matter of the present application has been developed to provide a golf practice system that overcome at least some of the above-discussed shortcomings of prior art techniques. More specifically, in some examples, the golf practice system of the present disclosure is configured to be anchored to a room without complex assembly and reliance on pre-existing fixtures within the room.

The following is a non-exhaustive list of examples, which may or may not be claimed, of the subject matter, disclosed herein.

Disclosed herein is a golf practice system that includes a first strap extendable, in tension, from a first anchor point to a second anchor point. The golf practice system also includes a second strap extendable, in tension, from a third anchor point to a fourth anchor point such that at least a portion of the second strap is parallel to and offset from at least a portion of the first strap. The golf practice system further includes a net system comprising an impact screen, a top netting, a first side netting, and a second side netting. The impact screen is collapsible, suspendable from the first strap, and slidable along the first strap. The top netting is collapsible, suspendable from the second strap, and slidable along the second strap. The preceding subject matter of this paragraph characterizes example 1 of the present disclosure.

The impact screen, the top netting, the first side netting, and the second side netting are coupled together such that the impact screen, the top netting, the first side netting, and the second side netting are co-movable relative to each other. The impact screen and the top netting are co-slidable along the first strap and the second strap, respectively. The preceding subject matter of this paragraph characterizes example 2 of the present disclosure, wherein example 2 also includes the subject matter according to example 1, above.

The golf practice system further includes a first pulley defining the first anchor point, a second pulley defining the third anchor point, a first ratcheting mechanism, and a second ratcheting mechanism. The first strap is engaged with the first pulley and the first ratcheting mechanism. The second strap is engaged with the second pulley and the second ratcheting mechanism. The first ratcheting mechanism is operable to tighten and loosen the first strap about the first pulley. The second ratcheting mechanism is operable to tighten and loosen the second strap about the second pulley.

The preceding subject matter of this paragraph characterizes example 3 of the present disclosure, wherein example 3 also includes the subject matter according to any of examples 1-2, above.

The golf practice system further includes anchor straps. Each one of the anchor straps is fixed to a corresponding portion of the net system and is selectively fixable to one of the first strap or the second strap to prevent movement of the corresponding portion of the net system to the one of the first strap or the second strap.

The preceding subject matter of this paragraph characterizes example 4 of the present disclosure, wherein example 4 also includes the subject matter according to any of examples 1-3, above.

When the impact screen is suspended from the first strap and the top netting is suspended from the second strap, the first side netting is parallel to and facing the second side netting, the top netting is perpendicular to the first side netting and the second side netting, and the impact screen is perpendicular to the first side netting, the second side netting, and the top netting. The preceding subject matter of this paragraph characterizes example 5 of the present disclosure, wherein example 5 also includes the subject matter according to any of examples 1-4, above.

The net system further includes a first strap-engagement sleeve coupled to the impact screen and a second strap-engagement sleeve coupled to the top netting. The first strap passes through and is slidable within the first strap-engagement sleeve when the impact screen is suspended from the first strap. The second strap passes through and is slidable within the second strap-engagement sleeve when the top netting is suspended from the second strap. The preceding subject matter of this paragraph characterizes example 6 of the present disclosure, wherein example 6 also includes the subject matter according to any of examples 1-5, above.

The first strap includes a first-strap intermediate strap segment, a first first-strap end strap segment selectively coupleable to the first-strap intermediate strap segment via a first-strap first clip, and a first-strap second end strap segment selectively coupleable to the first-strap intermediate strap segment via a first-strap second clip. The first-strap first end strap segment is extendable from the first anchor point to the first-strap intermediate strap segment. The first-strap second end strap segment is extendable from the second anchor point to the first-strap intermediate strap segment. The first-strap intermediate strap segment is longer than the impact screen and the impact screen is suspendable from the first-strap intermediate strap segment. The second strap includes a second-strap intermediate strap segment, a first second-strap end strap segment selectively coupleable to the second-strap intermediate strap segment via a second-strap first clip, and a second-strap second end strap segment selectively coupleable to the second-strap intermediate strap segment via a second-strap second clip. The second-strap first end strap segment is extendable from the third anchor point to the second-strap intermediate strap segment. The second-strap second end strap segment is extendable from the fourth anchor point to the second-strap intermediate strap segment. The second-strap intermediate strap segment is longer than the top netting and the top netting is suspendable from the second-strap intermediate strap segment. The preceding subject matter of this paragraph characterizes example 7 of the present disclosure, wherein example 7 also includes the subject matter according to any of examples 1-6, above.

The golf practice system further includes a hitting mat removably coupleable to the first side netting, the second side netting, and the impact screen along a seam. The preceding subject matter of this paragraph characterizes example 8 of the present disclosure, wherein example 8 also includes the subject matter according to any of examples 1-7, above.

The net system further includes covers that selectively cover corresponding portions of the seam. The preceding subject matter of this paragraph characterizes example 9 of the present disclosure, wherein example 9 also includes the subject matter according to example 8, above.

The golf practice system further includes weights. Each one of the weights is fixed to a corresponding one of the covers. The preceding subject matter of this paragraph characterizes example 10 of the present disclosure, wherein example 10 also includes the subject matter according to example 9, above.

The impact screen is removably coupled to the top netting, the first side netting, and the second side netting along a seam. The preceding subject matter of this paragraph characterizes example 11 of the present disclosure, wherein example 11 also includes the subject matter according to any of examples 1-10, above.

The golf practice system further includes a first track that defines a location of the first anchor point and the third anchor point. The golf practice system also includes a second track that defines a location of the second anchor point and the fourth anchor point. The second track is positionable away from the first track and substantially parallel to the first track. The first strap is extendable, in tension, from the first track to the second track. The second strap is extendable, in tension, from the first track to the second track such that the second strap is parallel to and offset from the first strap from the first track to the second track. The preceding subject matter of this paragraph characterizes example 12 of the present disclosure, wherein example 12 also includes the subject matter according to any of examples 1-11, above.

A position of the first anchor point and the second anchor point along the first track is adjustable. A position of the third anchor point and the fourth anchor point along the second track is adjustable. The preceding subject matter of this paragraph characterizes example 13 of the present disclosure, wherein example 13 also includes the subject matter according to example 12, above.

The golf practice system further includes an enclosure. The first track is fixed to and positioned within the enclosure. The first strap and the second strap extend out from the enclosure. The net system is slidable, along the first strap and the second strap, into the enclosure. The preceding subject matter of this paragraph characterizes example 14 of the present disclosure, wherein example 14 also includes the subject matter according to any of examples 12-13, above.

The golf practice system further includes a third track parallel to the first track and lying in a first hypothetical plane with the first track. The second track and the first track lie within a second hypothetical plane perpendicular to the first hypothetical plane. The golf practice system also includes a first pulley adjustably positionable along the first track and defining the first anchor point. The golf practice system additionally includes a second pulley adjustably positionable along the first track and defining the third anchor point. The golf practice system also includes a first ratcheting mechanism adjustably positionable along the third track. The golf practice system further includes a second ratcheting mechanism adjustably positionable along the third track. The first strap is engaged with the first pulley and the first ratcheting mechanism. The second strap is engaged with the second pulley and the second ratcheting mechanism. The first ratcheting mechanism is operable to tighten and loosen the first strap about the first pulley. The second ratcheting mechanism is operable to tighten and loosen the second strap about the second pulley. The preceding subject matter of this paragraph characterizes example 15 of the present disclosure, wherein example 15 also includes the subject matter according to any of examples 12-14, above.

Further disclosed herein is a method of using a golf practice system. The method includes tensioning a first strap between a first anchor point and a second anchor point. The method also includes tensioning a second strap between a third anchor point and a fourth anchor point so that at least a portion of the second strap is parallel to and offset from at least a portion of the first strap. The method further includes suspending a net system from the first strap and the second strap. The net system includes an impact screen, a top netting, a first side netting, and a second side netting. The method additionally includes sliding the net system along the first strap and the second strap into a desired practice location. The preceding subject matter of this paragraph characterizes example 16 of the present disclosure.

The first anchor point is defined by a first coupling. The second anchor point is defined by a second coupling. The third anchor point is defined by a third coupling. The fourth anchor point is defined by a fourth coupling. The method further includes anchoring the first coupling and the third coupling to a first side wall of a room.

The method additionally includes anchoring the second coupling and the fourth coupling to a second side wall of the room that is opposite the first side wall of the room. The preceding subject matter of this paragraph characterizes example 17 of the present disclosure, wherein example 17 also includes the subject matter according to example 16, above.

The first coupling includes a first pulley. The third coupling includes a second pulley. Tensioning the first strap includes ratcheting a first ratcheting mechanism to tighten the first strap about the first pulley. Tensioning the second strap includes ratcheting a second ratcheting mechanism to tighten the second strap about the second pulley. The preceding subject matter of this paragraph characterizes example 18 of the present disclosure, wherein example 18 also includes the subject matter according to example 17, above.

The method further includes anchoring the net system to the first strap and the second strap when the net system is in the desired practice location. The preceding subject matter of this paragraph characterizes example 19 of the present disclosure, wherein example 19 also includes the subject matter according to any of examples 16-18, above.

The first anchor point and the third anchor point are located within an enclosure such that the first strap and the second strap at least partially extend into the enclosure. Sliding the net system along the first strap and the second strap into the desired practice location includes sliding the net system out of the enclosure in a first direction. The method further includes sliding the net system along the first strap and the second strap in a second direction, opposite the first direction, from the desired location into the enclosure. The preceding subject matter of this paragraph characterizes example 20 of the present disclosure, wherein example 20 also includes the subject matter according to any of examples 16-19, above.

The described features, structures, advantages, and/or characteristics of the subject matter of the present disclosure may be combined in any suitable manner in one or more examples and/or implementations. In the following description, numerous specific details are provided to impart a thorough understanding of examples of the subject matter of the present disclosure. One skilled in the relevant art will recognize that the subject matter of the present disclosure may be practiced without one or more of the specific features, details, components, materials, and/or methods of a particular example or implementation. In other instances, additional features and advantages may be recognized in certain examples and/or implementations that may not be present in all examples or implementations. Further, in some instances, well-known structures, materials, or operations are not shown or described in detail to avoid obscuring aspects of the subject matter of the present disclosure. The features and advantages of the subject matter of the present disclosure will become more fully apparent from the following description and appended claims, or may be learned by the practice of the subject matter as set forth hereinafter.

BRIEF DESCRIPTION OF THE DRAWINGS

In order that the advantages of the subject matter may be more readily understood, a more particular description of the subject matter briefly described above will be rendered by reference to specific examples that are illustrated in the appended drawings. Understanding that these drawings, which are not necessarily drawn to scale, depict only certain examples of the subject matter and are not therefore to be considered to be limiting of its scope, the subject matter will be described and explained with additional specificity and detail through the use of the drawings, in which.

DETAILED DESCRIPTION

Reference throughout this specification to "one example," "an example," or similar language means that a particular feature, structure, or characteristic described in connection with the example is included in at least one example of the present disclosure. Appearances of the phrases "in one example," "in an example," and similar language throughout this specification may, but do not necessarily, all refer to the same example. Similarly, the use of the term "implementation" means an implementation having a particular feature, structure, or characteristic described in connection with one or more examples of the present disclosure, however, absent an express correlation to indicate otherwise, an implementation may be associated with one or more examples.

Figure 1:
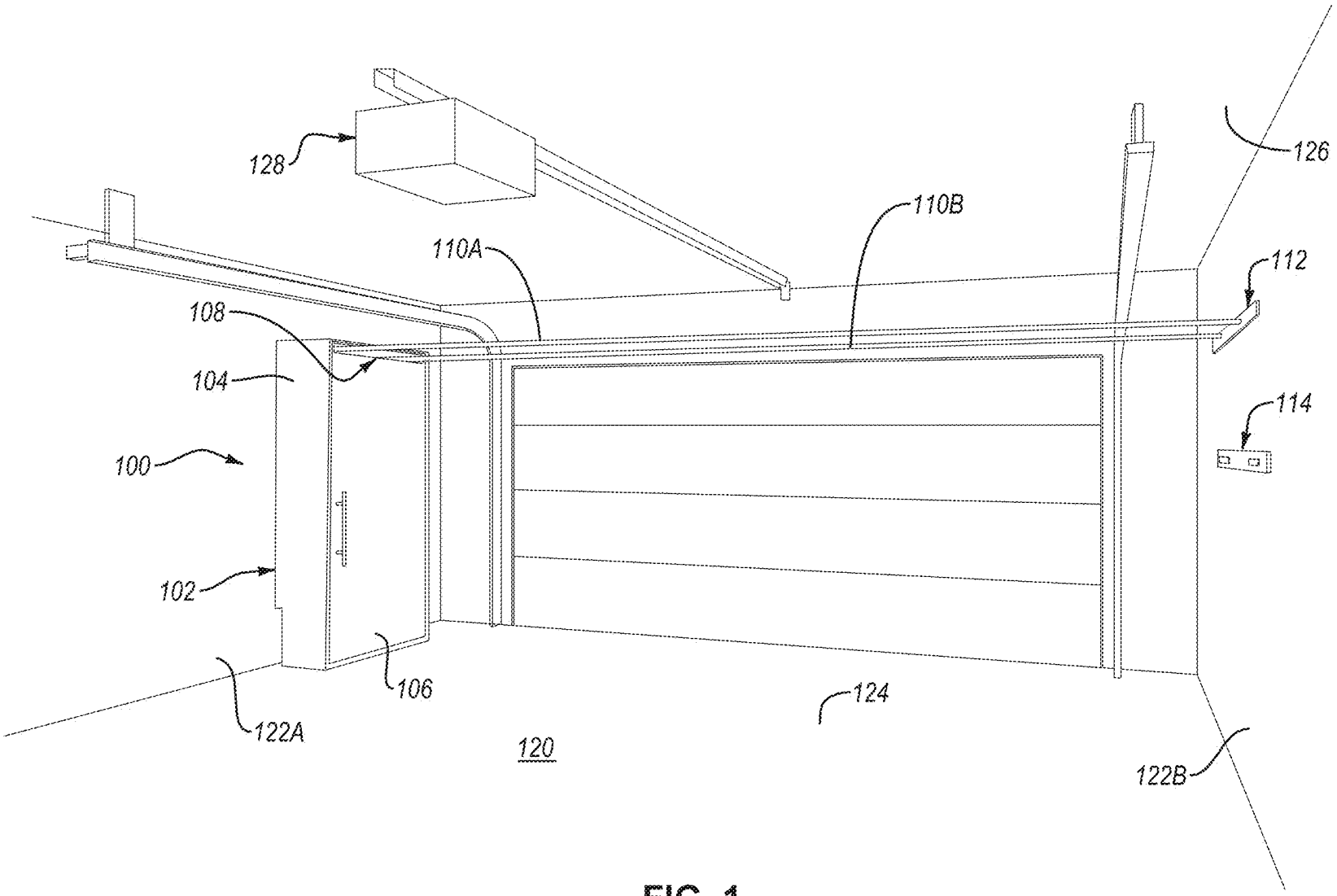
FIG. 1 is a perspective view of a golf practice system, shown in a stored state within a room, according to one or more examples of the present disclosure.

Referring to FIG. 1, according to some examples, a golf practice system 100 is shown situated within a room 120. As will be described in more detail below, the golf practice system 100 includes an impact screen, side netting, a top netting, and a mat. A golfer hits golf balls off the mat and into the impact screen. The side netting and the top netting help to capture errant golf balls The room 120 includes a floor 124 (e.g., ground), a first side wall 122A, a second side wall 122B, and a ceiling 126. The first side wall 122A is opposite the second side wall 122B. The room 120 can also include two opposing end walls. The room 120 can be an indoor room enclosed by walls and a ceiling. However, the room 120 can be a partially indoor or open room that is only partially enclosed by walls and a ceiling. For example, as shown, the room 120 can be a garage with a garage door system 128 configured to open and close an end of the garage by raising and lowering a garage door. Accordingly, the room 120 can include garage door system components, such as a motor, side rails, etc., attached to the ceiling of the room 120. But, as will be explained below, in various examples, when anchored to the walls of a garage, no portion of the golf practice system 100 is coupled to, attached to, or engaged with any components of a garage door system of the garage.

As will be described in more detail below, the first side wall 122A and the second side wall 122B are used to anchor the golf practice system 100 to the room 120. Accordingly, as will be appreciated, as broadly defined, the room 120 can be any space (e.g., outdoor or indoor) having opposing support structures, analogous to opposing side walls of a room, that can provide sufficient anchoring of the golf practice system 100. Therefore, although the description of the golf practice system 100 will proceed with reference to a first side wall 122A and a second side wall 122B of a room 120, it is recognized that the room 120 can be interchangeable with any space and the first side wall 122A and the second side wall 122B can be interchangeable with any anchoring structures analogous to walls of a room.

Figure 4A:
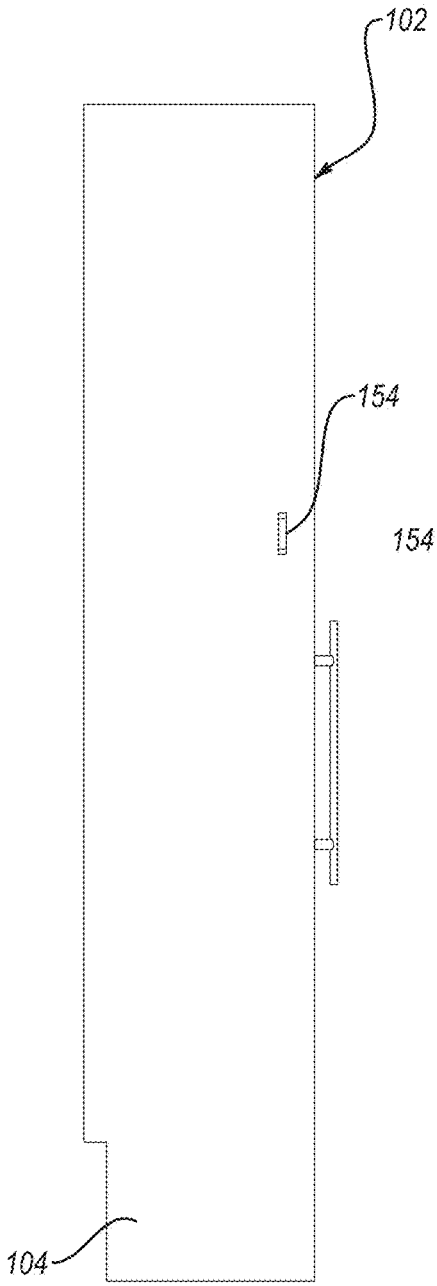
FIG. 4A is a side elevation view of an enclosure of the golf practice system of FIG. 1, according to one or more examples of the present disclosure.
Figure 4B:
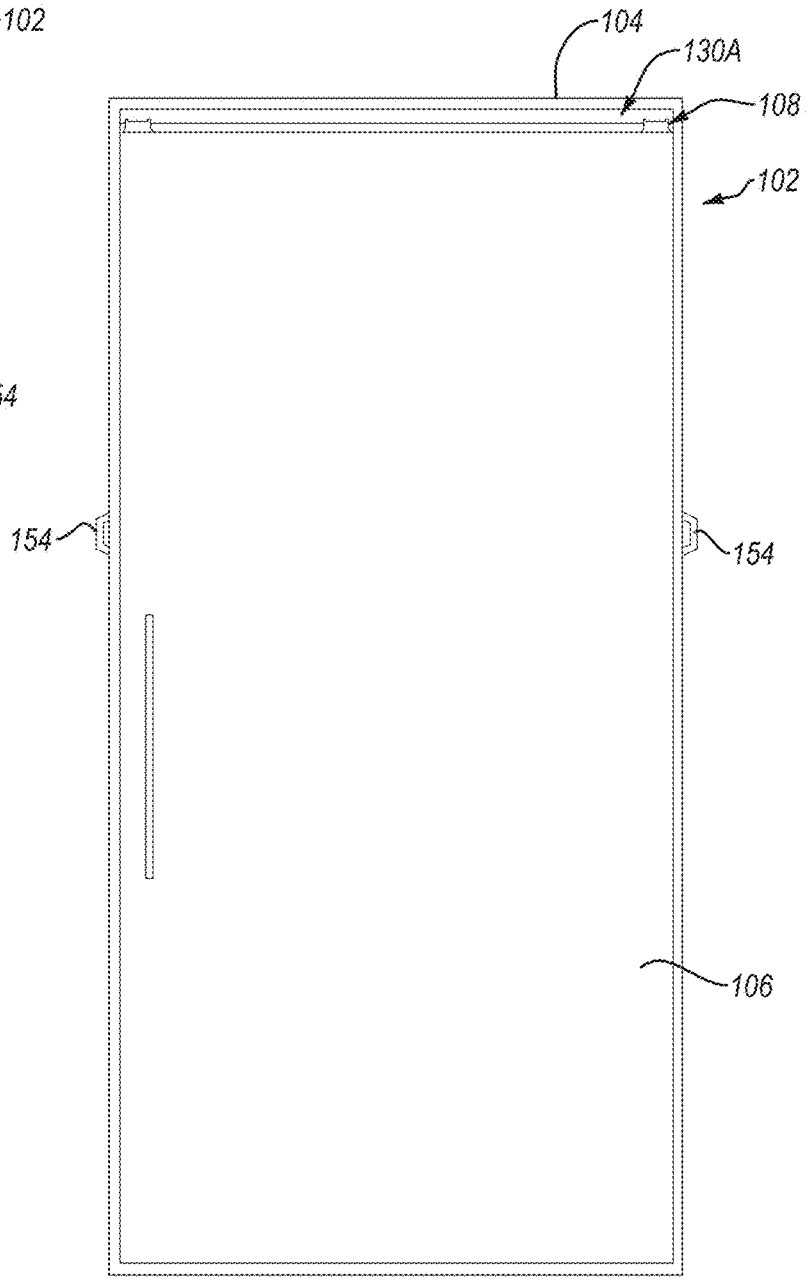
FIG. 4B is a front elevation view of the enclosure of FIG. 4A, according to one or more examples of the present disclosure.

In some examples, the golf practice system 100 includes an enclosure 102 (e.g., cabinet) that is mountable to a wall, such as the first side wall 122A. The enclosure 102 defines an interior cavity 158, which is defined by a frame 104 and a door 106 of the enclosure 102. The interior cavity 158 is widely accessible by opening the door 106 of the enclosure 102. Additionally, limited access to the interior cavity 158 is also available via a gap 108 defined between the frame 104 and a top of the door 106. As will be explained below, the gap 108 enables a front suspension strap 110A and a rear suspension strap 110B of the golf practice system 100 to pass into the interior cavity 158 when the door 106 is closed. In some examples, as shown in FIGS. 4A and 4B, the enclosure 102 has a low profile, such that a depth of the enclosure 102 is at least two times smaller than a width or a height of the enclosure 102. In this manner, the extent the enclosure 102 extends into the room 120 is limited, thus preserving space within the room 120 for using the golf practice system 100 or for other activities or uses.

The front suspension strap 110A and the rear suspension strap 110B extend from anchor points within the enclosure 102, across the room 120, to anchor points on the opposite side of the room, such as the second side wall 122B. The end of each one of the front suspension strap 110A and the rear suspension strap 110B terminates at a coupling 184, which is selectively retainable by an end track 112 of the golf practice system 100 (see. e.g., FIG. 9). The coupling 184 includes a channel engagement portion that slides into and is retained within a channel 186 of the end track 112. The end track 112 and the channel 186 can have any of various designs, such as shown or more similar to the upper track 130A, which is described below in more detail with reference to FIGS. 7-8C. Moreover, the coupling 184 can be configured to engage and be retained by the end track 112 in a manner similar to that described below in relation to the coupling 178A and the upper track 130A.

Figure 3:
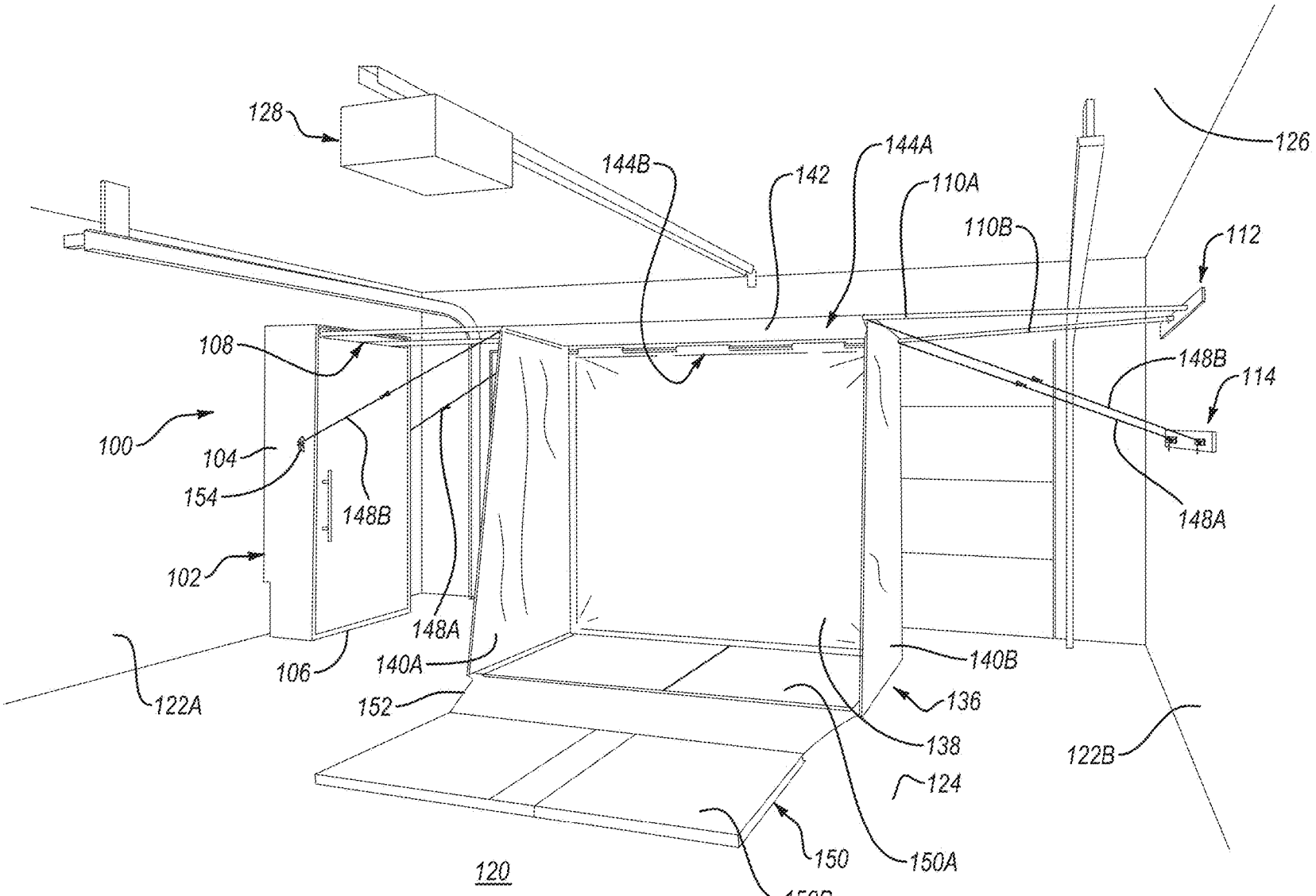
FIG. 3 is a perspective view of the golf practice system of FIG. 1, shown in a fully deployed state within the room, according to one or more examples of the present disclosure.

The end track 112 is mounted to the second side wall 122B, such that when the couplings of the front suspension strap 110A and the rear suspension strap 110B are retained by the end track 112, the ends of the front suspension strap 110A and the rear suspension strap 110B are anchored to the second side wall 122B. In the illustrated example, the front suspension strap 110A and the rear suspension strap 110B are parallel to each other, offset from each other, and located at a height above the floor 124 of the room 120. Referring to FIG. 3, the height is sufficient to enable the net system 136 to hang at an intended height. Also, when the room 120 is a garage, the height can be less than the components of the garage door system (e.g., motor, rails, etc.), so that the straps can remain in place and not interrupt the function of the garage door system. Additionally, the golf practice system 100 is not attached or coupled to any part of the garage door system. Moreover, the front suspension strap 110A and the rear suspension strap 110B are substantially parallel to the floor 124, such that the height of the front suspension strap 110A and the rear suspension strap 110B, relative to the floor 124, is constant along the length of the front suspension strap 110A and the rear suspension strap 110B. The straps of the golf practice system 100 can be any of various straps (e.g., nylon straps, leather straps, cloth straps, etc.), cords, chains, rope, and the like.

Figure 2:
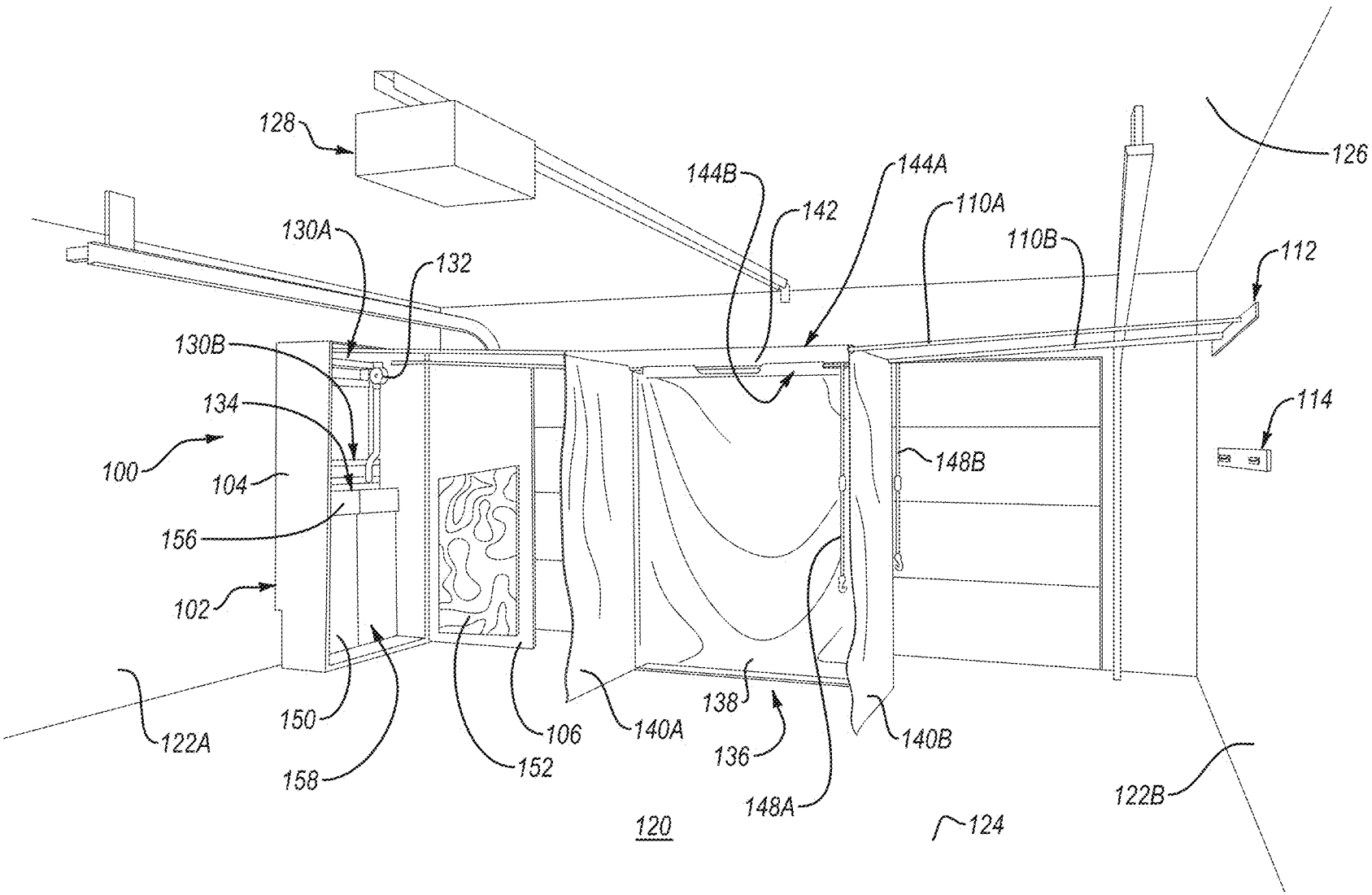
FIG. 2 is a perspective view of the golf practice system of FIG. 1, shown in a partially deployed state within the room, according to one or more examples of the present disclosure.

Referring to FIG. 2, the front suspension strap 110A and the rear suspension strap 110B are anchored to the first side wall 122A via an upper track 130A and a lower track 130B of the enclosure 102. The upper track 130A and the lower track 130B defines the corresponding anchor points for the straps. The upper track 130A and the lower track 130B are mounted to the first side wall 122A. In some examples, a portion of the frame 104 of the enclosure 102 is interposed between the upper track 130A and the lower track 130B, such that when the upper track 130A and the lower track 130B are mounted to the first side wall 122A, the enclosure 102 is also mounted to the first side wall 122A. It is recognized that in other examples, the enclosure 102 can be mounted to the first side wall 122A separately from the upper track 130A and the lower track 130B. The upper track 130A is positioned above and is parallel to the lower track 130B. Put another way, the upper track 130A and the lower track 130B lie within a first hypothetical plane (e.g., a vertical plane), and the upper track 130A and the end track 112 lie within a second hypothetical plane (e.g., a horizontal plane) that is perpendicular to the first hypothetical plane. Both the upper track 130A and the lower track 130B are parallel to the floor 124 when mounted to the first side wall 122A. The end track 112, the upper track 130A, and the lower track 130B can be mounted to a corresponding one of the walls via any of various mounting techniques, such as fastening (including anchoring using anchors), welding, adhering, and the like. For example, referring to FIG. 7, each one of the end track 112, the upper track 130A, and the lower track 130B can include mounting apertures 174, 176 through which fasteners extend into the walls to anchor the tracks to the walls.

The front suspension strap 110A and the rear suspension strap 110B are adjustably secured to the upper track 130A, via a corresponding one of two pulleys 132 (e.g., couplings) retained by the upper track 130A, and adjustably secured to the lower track 130B, via a corresponding one of two ratcheting mechanisms 134 retained by the lower track 130B. Referring to the front suspension strap 110A, after entering the enclosure 102, it is engaged with a front one of the two pulleys 132 and redirected (e.g., downward) toward a front one of the two ratcheting mechanisms 134, which receives and retains the front suspension strap 110A. Actuation (e.g., ratcheting) of the front one of the two ratcheting mechanisms 134 draws the front suspension strap 110A further into the enclosure 102, which is facilitated by the front one of the two pulleys 132 co-moving with the front suspension strap 110A in a tightening direction, and acts to tighten the front suspension strap 110A. The front ones of the pulleys 132 and the ratcheting mechanisms 134 form a front set. Excess portions of the front suspension strap 110A and the rear suspension strap 110B can be stored in a pocket defined between a partition 162 within the enclosure 102 and a back wall of the frame 104. It is recognized that in some examples, the pulleys 132 can be coupled with the lower track 130B and the ratcheting mechanisms 134 can be coupled with the upper track 130A. Also, although "upper" and "lower" are used to define the tracks, it is recognized that the tracks need not be directly above or below the other.

In contrast, releasing the front one of the two ratcheting mechanisms 134 allows the front suspension strap 110A to move out of the enclosure 102, which is facilitated by the front one of the two pulleys 132 co-moving with the front suspension strap 110A in a releasing direction (opposite the tightening direction), and acts to release the tension in the front suspension strap 110A. In this manner, the front suspension strap 110A is adjustably tensioned and loosened. The rear suspension strap 110B is similarly adjustably tensioned and loosened using the rear ones of the two pulleys 132 and ratcheting mechanisms 134, which form a rear set.

Figure 7:
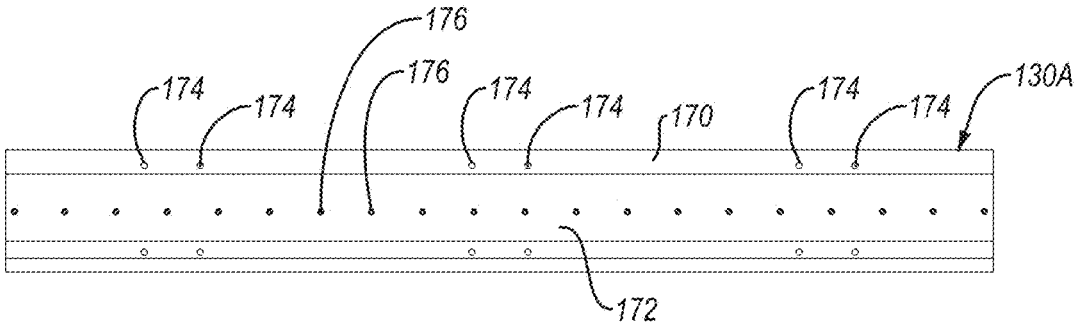
FIG. 7 is a front elevation view of a track of a golf practice system, according to one or more examples of the present disclosure.
Figure 8A:
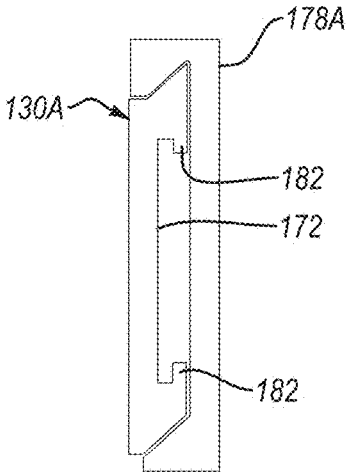
FIG. 8A is a side elevation view of a first coupling engaged with the track of FIG. 7, according to one or more examples of the present disclosure.
Figure 8B:
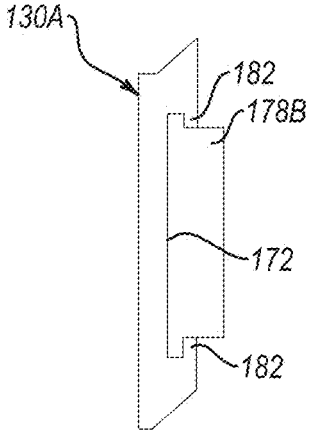
FIG. 8B is a side elevation view of a second coupling engaged with the track of FIG. 7, according to one or more examples of the present disclosure.
Figure 8C:
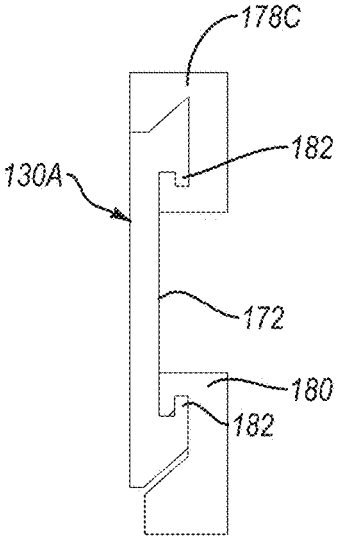
FIG. 8C is a side elevation view of a third coupling engaged with the track of FIG. 7, according to one or more examples of the present disclosure.
Figure 9:
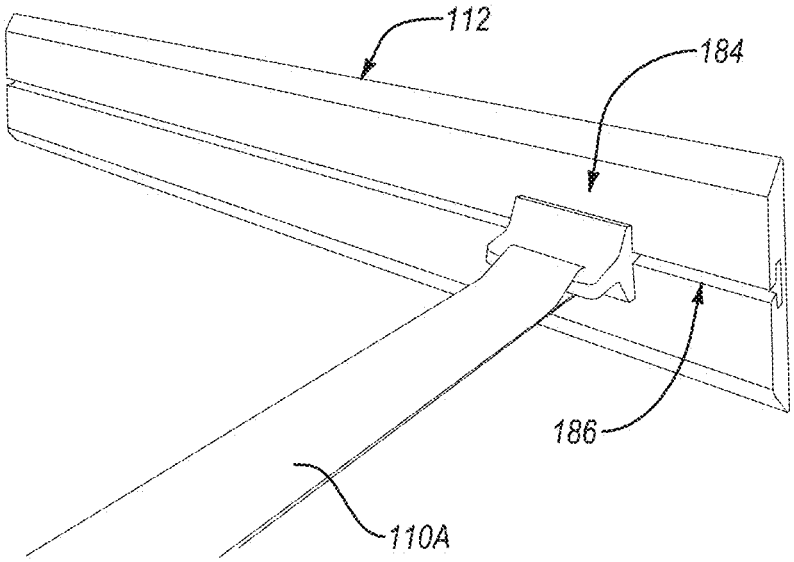
FIG. 9 is a perspective view of another track of a golf practice system, according to one or more examples of the present disclosure.

The position of the pulleys 132 and the ratcheting mechanisms 134 along the length of the upper track 130A and the lower track 130B, respectively, is adjustable. Referring to FIGS. 7-8C, the upper track 130A includes a channel 172 extending along the length of a base 170 of the upper track 130A. Opposing overhangs 182 on the top and bottom of the channel 172 define partially enclosed portions of the channel 172. Additionally, a top of the upper track 130A can include an upwardly extending protrusion. The lower track 130B can be configured the same as the upper track 130A. Each one of the pulleys 132 and the ratcheting mechanisms 134 includes a coupling configured to slidably engage and be retained by the upper track 130A and the lower track 130B, respectively. One example of a coupling 178A is shown in FIG. 8A. The coupling 178A is designed to slidably engage the upwardly extending protrusion of the upper track 130A and hang down around the upper track 130A without being received within the channel 172. Another example of a coupling 178B is shown in FIG. 8B, and is configured to slidably engage with and be received within the channel 172. A further example of a coupling 178C is shown in FIG. 8C, and is configured to slidably engage with the upwardly extending protrusion of the upper track 130A, and slidably engage with and be received within the partially enclosed portion of the channel 172. In the example of FIG. 8C, a lower portion of the channel 172 of the upper track 130A can be further utilized to receive and support a coupling 180 of another component or accessory of the golf practice system 100. It is recognized that in other examples the coupling can have any of various alternative configurations, such as cleats, that enable the pulleys, ratcheting mechanisms, and/or other accessories to be adjustably and selectively retained by the tracks.

In some examples, the position of the pulleys 132 and the ratcheting mechanisms 134 along the tracks can be releasably adjusted. In some examples, retention and adjustability of the positions of the pulleys 132 and the ratcheting mechanisms 134 are facilitated by the interlocking engagement between the couplings and the tracks (see, e.g., FIGS. 8A-8C). Adjustment of the positions of the front set (i.e., front pulley and front ratcheting mechanism) and the rear set (i.e., rear pulley and rear ratcheting mechanism) relative to each other correspondingly changes the spacing between the front suspension strap 110A and the rear suspension strap 110B. Changing the spacing between straps can accommodate nets of different depths. Alternatively, the positions of the front suspension strap 110A and the rear suspension strap 110B along the length of the upper track 130A and the lower track 130B can be adjusted, while keeping the distance between the straps the same. This enables the front suspension strap 110A and the rear suspension strap 110B to be in a desirable position even when the positions of anchoring structures of the wall (e.g., studs) do not align with the desired position of the straps.

Referring to FIGS. 2 and 3, the golf practice system 100 further includes a net system 136 that is slidably coupled with the front suspension strap 110A and the rear suspension strap 110B, such that the net system 136 can slide along the front suspension strap 110A and the rear suspension strap 110B. The net system 136 includes an impact screen 138, a first side netting 140A, a second side netting 140B, and a top netting 142, all made of flexible materials. In one example, the impact screen 138 is made of a material that is at least one of more durable, less porous, and more rigid than the material of the netting. According to an example, the first side netting 140A, the second side netting 140B, and the top netting 142 are made of a mesh material and the impact screen 138 is made of a heavy-duty polyester material. In some examples, when suspended from the suspension straps, the first side netting 140A is parallel to and facing the second side netting 140B, the top netting 142 is perpendicular to the first side netting 140A and the second side netting 140B, and the impact screen 138 is perpendicular to the first side netting 140A, the second side netting 140B, and the top netting 142.

Figure 6:
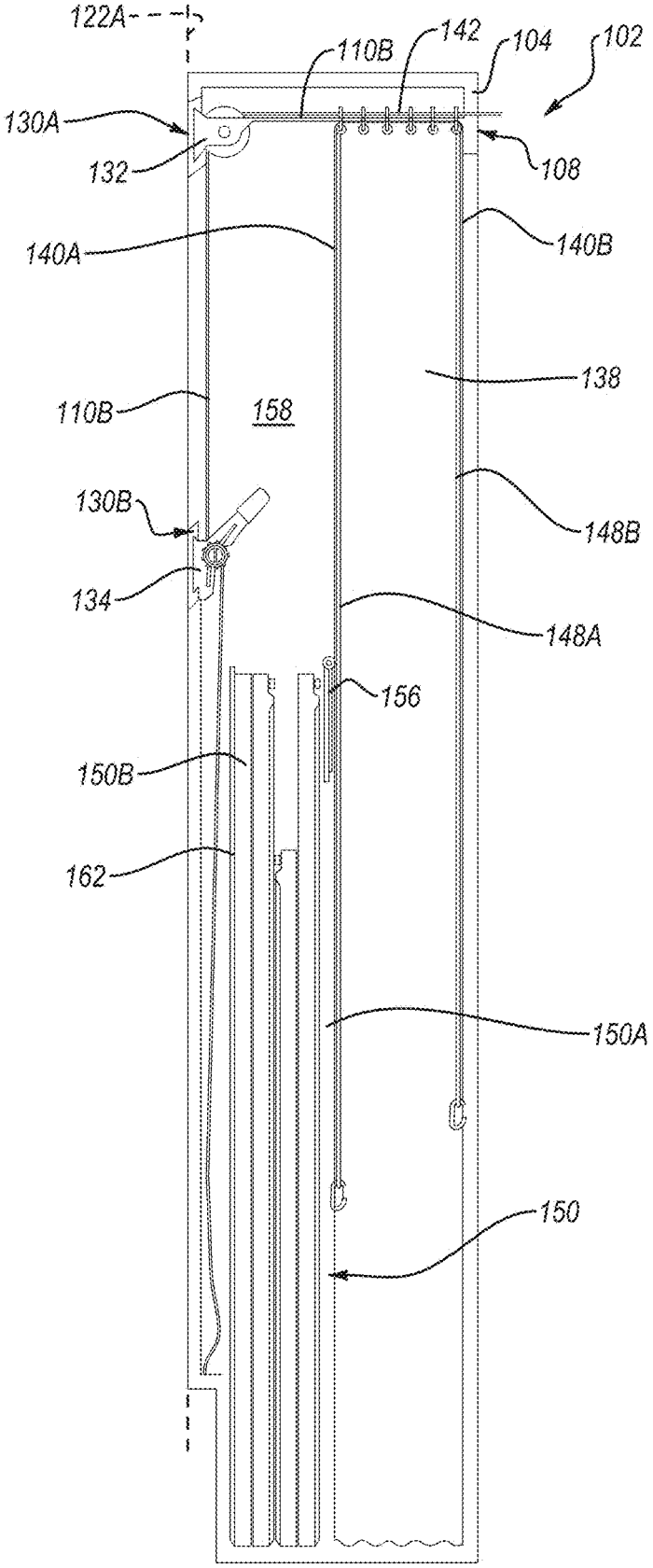
FIG. 6 is a cross-sectional side elevation view of the enclosure of FIG. 4A, according to one or more examples of the present disclosure.

In some examples, the impact screen 138 includes a rear strap engagement portion 144B, which can include openings through which the rear suspension strap 110B is alternatively threaded. In other embodiments, such as shown in FIG. 6, the rear strap engagement portion 144B includes a plurality of rings through which the rear suspension strap 110B passes. According to yet other examples, the rear strap engagement portion 144B is a sleeve through which the rear suspension strap 110B passes. The front edge of the top netting 142 also includes a front strap engagement portion 144A (e.g., apertures, rings, a sleeve, etc.) configured to slidably engage the front suspension strap 110A. Engagement between the front suspension strap 110A and the rear suspension strap 110B and the strap engagement portions of the net system 136 also maintains the net system 136 at a desired height corresponding with the height of the front suspension strap 110A and the rear suspension strap 110B. In this manner, the net system 136 is suspended from the front suspension strap 110A and the rear suspension strap 110B.

The net system 136 is configured to collapse, into a collapsed state, and expand, into an expanded state. In the collapsed state, at least the impact screen 138 and the top netting 142 is folded onto themselves, such as shown in FIG. 6, which is a cross-section of the enclosure 102 when the net system 136 is in the collapsed state within the interior cavity 158 of the enclosure 102. The net system 136 can remain in the collapsed state in the enclosure 102 (e.g., with the door 106 closed) when the room 120 is being used for purposes alternative to practicing golf, such as to park cars in a garage. Then, when use of the golf practice system 100 is desired, the door 106 is opened and the net system 136 is pulled out of the enclosure 102 and slide along the front suspension strap 110A and the rear suspension strap 110B, as shown in FIG. 2. The net system 136, when in a desired location between the first side wall 122A and the second side wall 122B, is fully expanded in the expanded state, such as shown in FIG. 3. In the expanded state, first tension straps 148A (e.g., anchor straps) of the net system 136, on a first side of the net system 136, are attached to corresponding coupling elements 154 fixed to the enclosure 102. Similarly, second tension straps 148B (e.g., anchor straps) of the net system 136, on a second side of the net system 136, are attached to a tension track 114 of the golf practice system 100. The tension track 114 is mounted to the second side wall 122B. The first tension straps 148A and the second tension straps 148B can be tensioned (such as via tensioning devices (e.g., buckles) on the straps) to tighten the impact screen 138 and the top netting 142, and to keep the net system 136 in the desired location.

Figure 5:
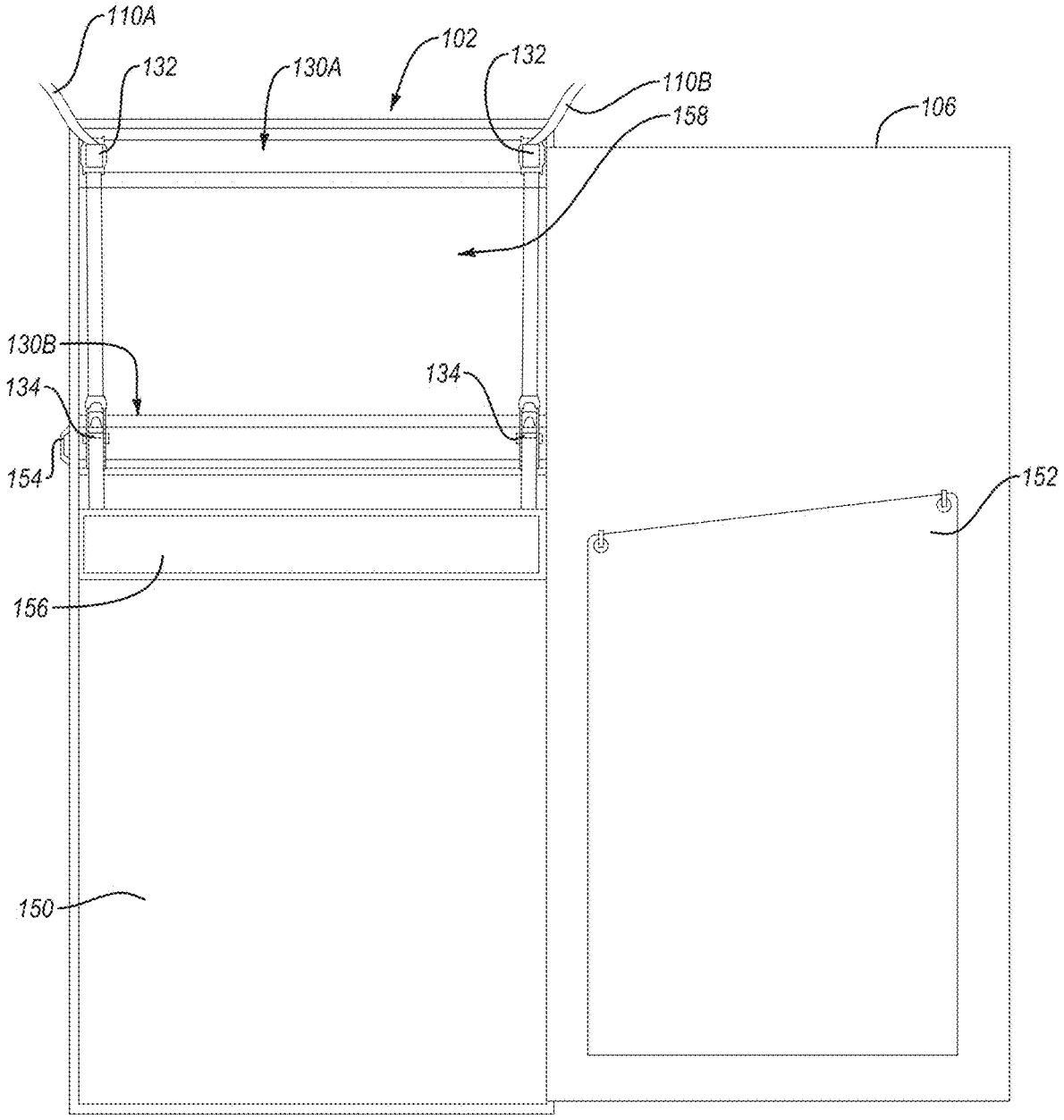
FIG. 5 is a front elevation view of the enclosure of FIG. 4A, depicted with a door of the enclosure opened to show an interior of the enclosure, according to one or more examples of the present disclosure.

The golf practice system 100 also includes a collapsible mat 150 that is collapsible so as to fit within the interior cavity 158 of the enclosure 102. In some examples, as shown in FIG. 5, the enclosure 102 includes a retaining bar 156 that spans a width of the enclosure 102 and helps to keep the collapsible mat 150 within the enclosure 102 when not in use. The collapsible mat 150 folds in on itself when collapsed, and includes a ball receiving portion 150A and a ball hitting portion 150B. When the net system 136 is in the expanded state, the collapsible mat 150 can be removed from the enclosure 102 and expanded, such as shown in FIG. 3.

Figure 10:
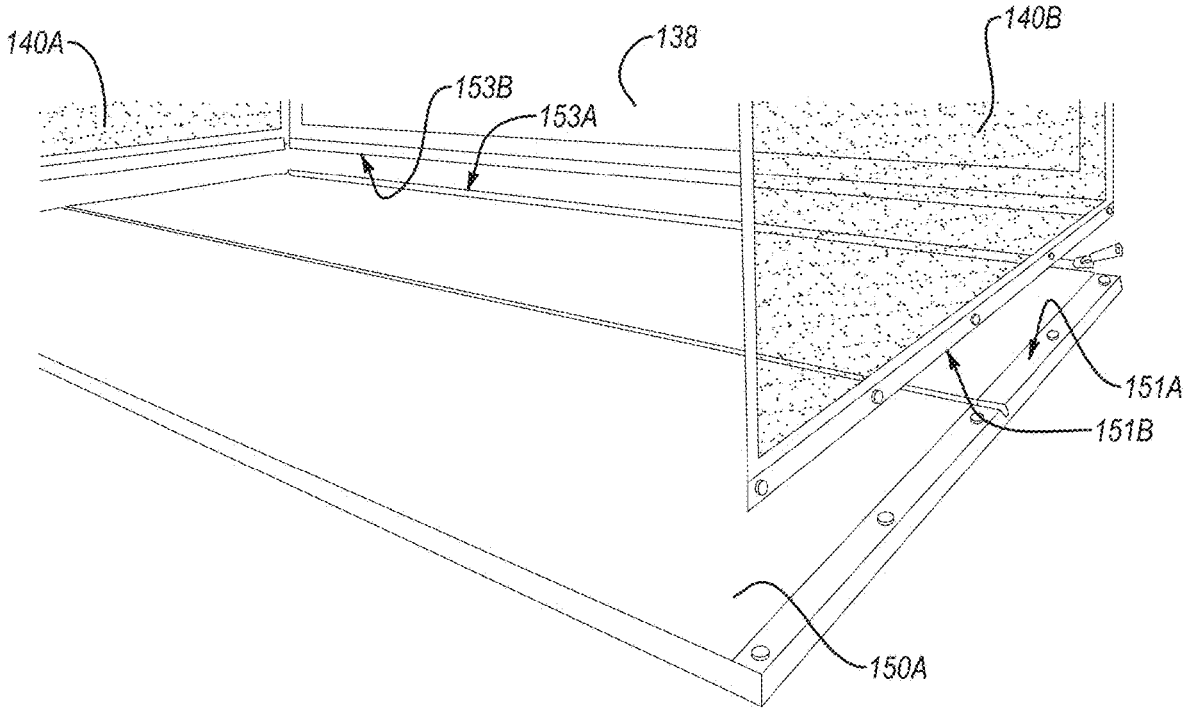
FIG. 10 is a perspective view of a net system being coupled to a mat of a golf practice system, according to one or more examples of the present disclosure.

The net system 136 is attached to the ball receiving portion 150A so that the ball receiving portion 150A is underneath the top netting 142 and laterally adjacent the first side netting 140A and the second side netting 140B. Referring to FIG. 10, in some examples, a first net engagement portion 153A of the ball receiving portion 150A is configured to releasably engage a first mat engagement portion 153B of the impact screen 138. The first net engagement portion 153A and the first mat engagement portion 153B can be selectively releasably engageable using any various coupling devices, such as zippers (as shown), buttons, magnets, hook-and-loop fasteners, clips, buckles, and the like. Similarly, a second net engagement portion 151A of the ball receiving portion 150A is configured to releasably engage a second mat engagement portion 151B of the first and second side netting 140A, 140B. The second net engagement portion 151A and the second mat engagement portion 151B can be selectively releasably engageable using any various coupling devices, such as zippers, buttons (as shown), magnets, hook-and-loop fasteners, clips, buckles, and the like. With the ball receiving portion 150A positioned below the top netting 142, the ball receiving portion 150A is able to receive thereon balls before being struck into the impact screen 138 of the net system 136. The ball hitting portion 150B is located in front of the net system 136 and the ball receiving portion 150A, and is configured to provide a surface from which balls can be struck into the impact screen 138 of the net system 136.

In some examples, the golf practice system 100 includes a mat bridge 152 that bridges a gap between the ball receiving portion 150A and the ball hitting portion 150B of the collapsible mat 150. Referring to FIG. 2, the mat bridge 152 can be affixed to an interior surface of the door 106, and stored within the enclosure 102, when not in use.

After use of the net system 136, it can be collapsed and stored within the enclosure 102. Collapsing the net system 136 includes decoupling the first tension straps 148A from the enclosure 102 and decoupling the second tension straps 148B from the tension track 114. Then, after the ball receiving portion 150A of the collapsible mat 150 is decoupled from the net system 136, the net system 136 can be collapsed upon itself and slid along the front suspension strap 110A and the rear suspension strap 110B towards the enclosure 102. Before, or after, the collapsible mat 150 is folded on itself and placed in the enclosure 102, the net system 136 is slid into the enclosure 102, and the door 106 can be closed to conceal the net system 136 within the enclosure 102. As mentioned above, the front suspension strap 110A and the rear suspension strap 110B, being at an elevated height above the floor 124, can remain in tension and in place without affecting other uses of the room 120. Then, when use of the golf practice system 100 is desired, the net system 136 can be quickly and easily slid out from the enclosure 102 and used again.

Although, in the illustrated example, the enclosure 102 is on the first side wall 122A and the end track 112 and the tension track 114 are on the second side wall 122B, in other examples, the locations can be reversed such that the enclosure 102 is on the second side wall 122B, and the end track 112 and the tension track 114 are on the first side wall 122A.

Figure 11:
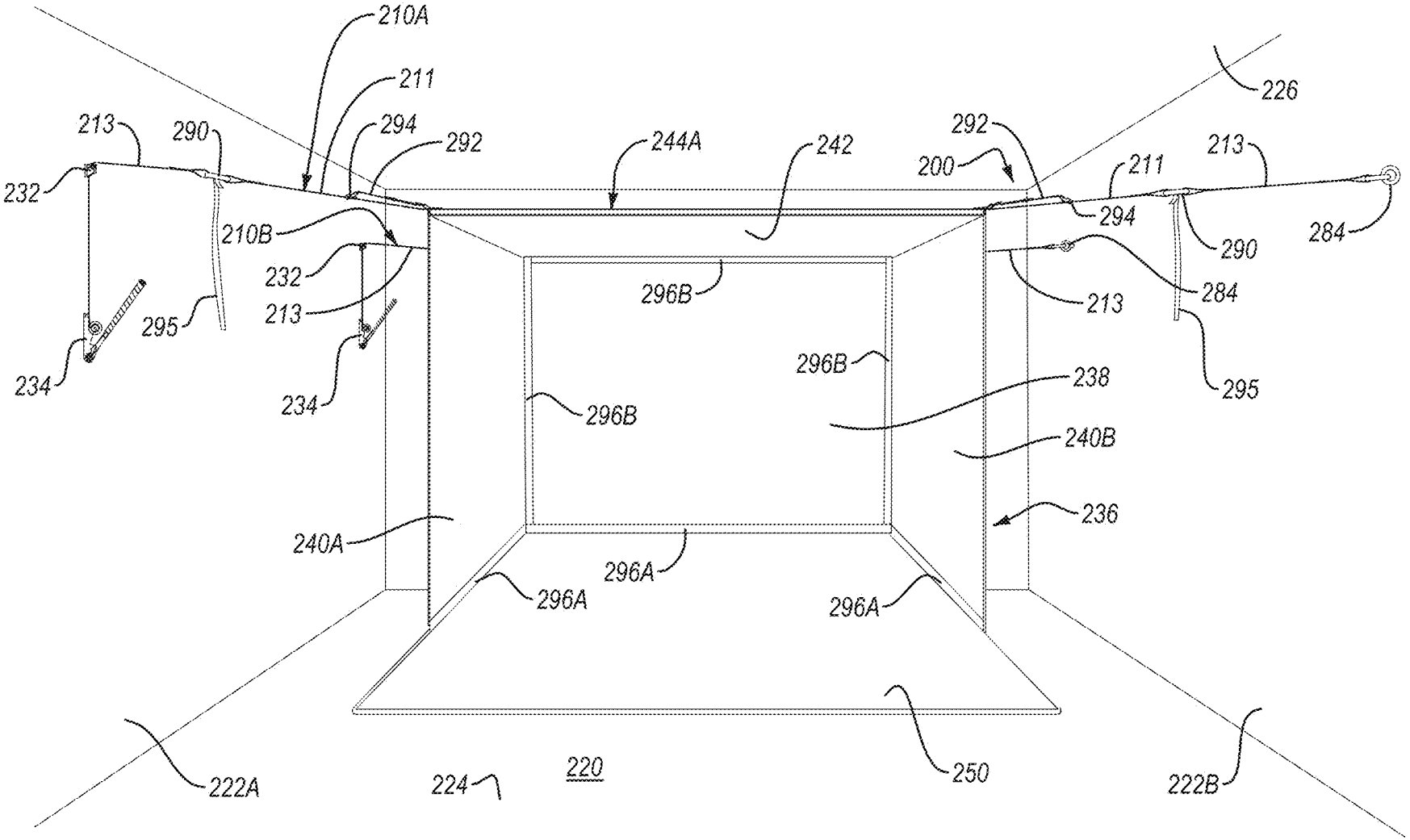
FIG. 11 is a front view of a golf practice system, according to one or more examples of the present disclosure.
Figure 12:
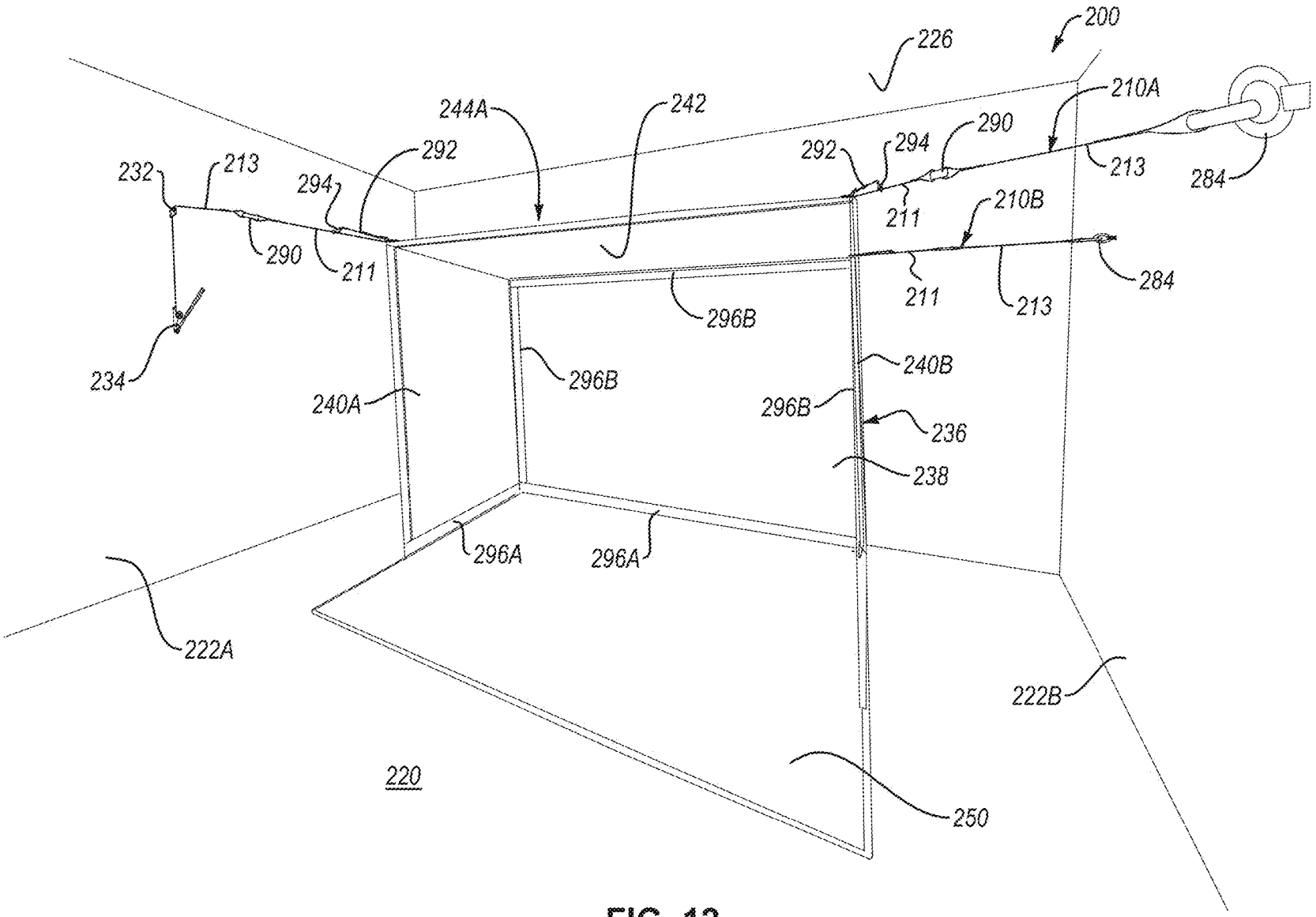
FIG. 12 is a perspective view of the golf practice system of FIG. 11, according to one or more examples of the present disclosure.
Figure 13:
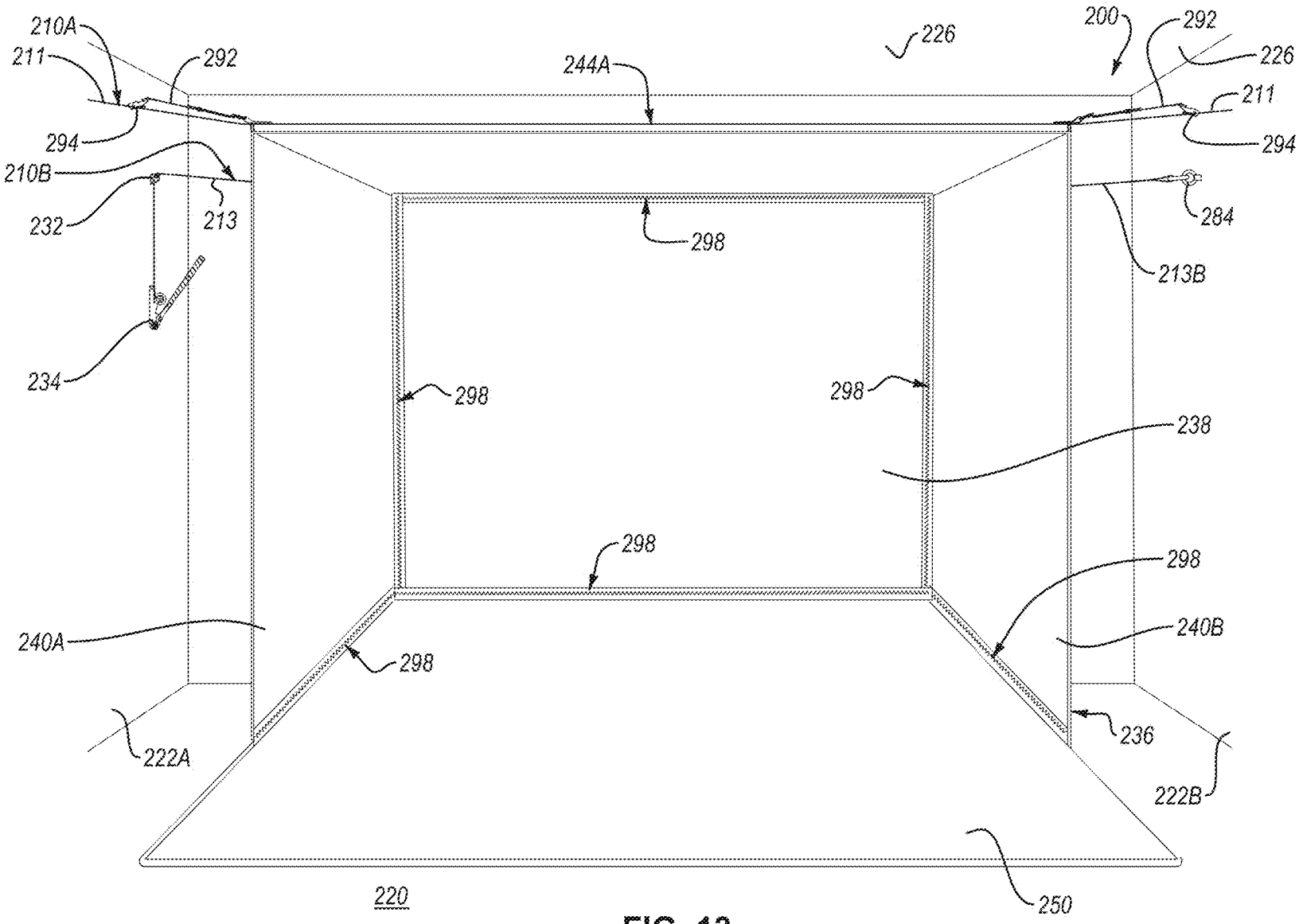
FIG. 13 is a front view of the golf practice system of FIG. 11, depicted with zipper covers removed to show underlying zippers, according to one or more examples of the present disclosure.

Referring to FIGS. 11-13, according to other examples, a golf practice system 200 is shown situated within a room 220. Like the room 120, the room 220 includes a floor 224, a first side wall 222A, a second side wall 222B, and a ceiling 226. In one example, unlike the room 120, the room 220 is not a garage and thus does not have a garage door system 128. However, in other examples, the room 220 can be a garage with a garage door system.

The golf practice system 200 is similar to the golf practice system 100, with like reference numbers referring to like features. It will be understood that the 200-series elements correspond to the 100-series elements, and the descriptions of the 100-series elements are intended to apply equally to the corresponding 200-series elements, unless explicitly stated otherwise. For example, like the golf practice system 100, the golf practice system 200 includes a net system 236, a front suspension strap 210A, and a rear suspension strap 210B. The net system 236 is slidably coupled with the front suspension strap 210A and the rear suspension strap 210B, such that the net system 236 can slide along the front suspension strap 210A and the rear suspension strap 210B. The net system 236 additionally includes an impact screen 238, a first side netting 240A, a second side netting 240B, and a top netting 242. A front strap engagement portion 244A and a rear strap engagement portion (not shown) of the net system 236 engage and enable slidable coupling with the front suspension strap 210A and the rear suspension strap 210B, respectively. In one example, each one of the front strap engagement portion 244A and the rear strap engagement portion includes a sleeve through which a respective one of the front suspension strap 210A and the rear suspension strap 210B passes.

Like the golf practice system 100, first ends of the front suspension strap 210A and the rear suspension strap 210B are anchored at anchor points to the first side wall 222A via a pulley 232 and a ratcheting mechanism 234. Accordingly, the pulleys 232 can define the anchor points. However, unlike the golf practice system 100, the pulley 232 and the ratcheting mechanism 234 are attached directly to the first side wall 222A, rather than indirectly via upper and lower tracks. Additionally, like the golf practice system 100, second ends of the front suspension strap 210A and the rear suspension strap 210B are anchored to the second side wall 222B. However, unlike the golf practice system 100, the second ends of the front suspension strap 210A and the rear suspension strap 210B are attached to couplings 284 (e.g., eyelet anchors, eyebolt, etc.) that are directly attached to the second side wall 222B, rather than indirectly via an end track. The couplings 284 define the corresponding anchor points of the straps. The more direct attachment of the ends of the front suspension strap 210A and the rear suspension strap 210B to the first side wall 222A and the second side wall 222B, rather than via tracks, helps to simplify the assembly and installation of the golf practice system 200.

The front suspension strap 210A and the rear suspension strap 210B can be parallel to each other from the first side wall 222A to the second side wall 222B. However, in some examples, the front suspension strap 210A and the rear suspension strap 210B are parallel to each other along only portions of the front suspension strap 210A and the rear suspension strap 210B from the first side wall 222A to the second side wall 222B. For example, the portions of the front suspension strap 210A and the rear suspension strap 210B engaged with the strap engagement portions of the net system 236 can be parallel, but the portions of the front suspension strap 210A and the rear suspension strap 210B exiting away from the strap engagement portions can be angled relative to each other. In other words, the portions of the front suspension strap 210A and the rear suspension strap 210B exiting away from the strap engagement portions can be angled relative to the portions of the front suspension strap 210A and the rear suspension strap 210B passing through the strap engagement portions.

Each one of the front suspension strap 210A and the rear suspension strap 210B are segmented to accommodate setting up (e.g., suspending) and taking down (e.g., storing) the net system 236. Unless otherwise noted, the following description of a suspension strap is applicable to both of the front suspension strap 210A and the rear suspension strap 210B. The suspension strap includes an intermediate strap segment 211 and two end strap segments 213. The intermediate strap segment 211 is between the two end strap segments 213. Moreover, the intermediate strap segment 211 is selectively removably coupled to each one of the end strap segments 213 via a clip 290. The clip 290 can be any of various clips (e.g., carabiner, snap hooks, trigger clips, bolt snaps, quick-release buckles, and the like) configured to enable the intermediate strap segment 211 to be quickly and easily attached to and detached from the end strap segments 213. Accordingly, an inner end of each one of the end strap segments 213 is coupled to a corresponding one of two clips 290. An outer end of one of the end strap segments 213 is engaged with the ratcheting mechanism 234, and the outer end of the other one of the end strap segments 213 is coupled to the coupling 284. The intermediate strap segment 211 has a length that is longer than a width/length of the top netting 242 so that the intermediate strap segment 211 can be engaged with a strap engagement portion of the net system 236 and extend beyond both ends of the strap engagement portion.

The strap segments of the front suspension strap 210A and the rear suspension strap 210B can be differently sized to accommodate differently sized rooms. For example, for larger rooms, the golf practice system 200 can include longer end strap segments 213. In some examples the golf practice system 200 can include a kit of end strap segments 213 of different lengths and the user can select end strap segments 213 of the kit of end strap segments 213 that best accommodate the user's room.

According to some examples, the end strap segments 213 (with the intermediate strap segment 211 detached therefrom) can remain coupled to the pulley 232 and ratcheting mechanism 234, and to the coupling 284, when the golf practice system 200 is not set up or stored. Thus, the end strap segments 213 can hang down from the pulley 232 and the coupling 284, and remain coupled to the first side wall 222A and the second side wall 222B, when the golf practice system 200 is not set up. Alternatively, if desired, the end strap segments 213 can be removed from the first side wall 222A and the second side wall 222B when the golf practice system 200 is not set up.

To set up the golf practice system 200, the user ensures the intermediate strap segment 211 is engaged with (e.g., threaded through) the corresponding strap engagement portion of the net system 236. The user selectively couples (e.g., clips) the ends of the intermediate strap segment 211 to corresponding ones of the clips 290 to form as assembled suspension strap. If needed, the user can tighten the assembled suspension strap until the suspension strap reaches a desired tautness. The pulley 232 and the coupling 284 are located at a height above the floor 224 that is equal to or greater than the maximum height of the net system 236. When both the front suspension strap 210A and the rear suspension strap 210B are engaged with the net system 236 and tightened in this manner, the net system 236 is vertically fixed (e.g., suspended) at a fixed height above the floor 224.

To facilitate horizontal fixation of the net system 236 along the front suspension strap 210A and the rear suspension strap 210B (i.e., to retain the net system 236 at a fixed location between the first side wall 222A and the second side wall 222B, in some examples, the golf practice system 200 includes anchor straps 292. Each one of the anchor straps 292 is coupled to a corresponding one of four corners of the top netting 242. In some examples, the anchor straps 292 are permanently fixed to the four corners. However, in other examples, the anchor straps 292 are releasably fixed to the four corners, such as via buckles, clips, rings, and the like. The ends of the anchor straps 292 away from the four corners include a releasable anchor 294. Accordingly, each one of the anchor straps 292 is fixed on one end to a corresponding one of the four corners of the top netting 242 and includes a releasable anchor 294 on the opposite end. The releasable anchors 294 are configured to receive a portion of an intermediate strap segment 211 and be selectively secured or fixed to the intermediate strap segment 211. In one example, the releasable anchor 294 is a cam buckle that includes a spring-loaded lever to press down "teeth" against an intermediate strap segment 211 where the lever can be pressed to release the teeth from the intermediate strap segment 211. When the teeth are not engaged with the intermediate strap segment 211, the releasable anchor 294 can be freely slidable and repositionable along the intermediate strap segment 211. When the net system 236 is slid along the front suspension strap 210A and the rear suspension strap 210B into a desired horizontal position between the side walls of the room 220, and with the anchor straps 292 relatively tight, the releasable anchors 294 can be engaged with a corresponding one of the intermediate strap segment 211. For a given intermediate strap segment 211, each one of the anchor straps 292, being engaged with the intermediate strap segment 211, resists movement of opposing corners of the top netting 242 towards each other, thus securing the horizontal position of the net system 236 along the front suspension strap 210A and the rear suspension strap 210B.

In some examples, after the net system 236 is vertically fixed and horizontally fixed, a hitting mat 250 of the golf practice system 200 can be coupled to the net system 236. Referring to FIG. 13, in some examples, the hitting mat 250 is coupled to the net system 236 via zippers 298 extending along a seam between the hitting mat 250 and the first side netting 240A, the second side netting 240B, and the impact screen 238. Additionally, in some examples, the golf practice system 200 includes covers 296A that cover the zippers 298 along the seam. The covers 296A help to protect the zippers 298 from golf balls hit into the net system 236. According to various examples, the covers 296A can be at least partially removable (e.g., via hook-and-loop fasteners) to expose the zippers 298 when separation of the hitting mat 250 from the net system 236 is desired, such as for storage of the net system 236. In some examples, the covers 296A include one or more weights, which can be sewn into the covers 296A, that help to weigh down the first side netting 240A, the second side netting 240B, and the impact screen 238. Weighing down the first side netting 240A, the second side netting 240B, and the impact screen 238 helps to maintain the position of the lower portions of the net system 236 during use.

As further shown in FIG. 13, the impact screen 238 can be coupled to the first side netting 240A, the second side netting 240B, and the top netting 242 via zippers 298 extending along a seam between the impact screen 238 and the first side netting 240A, the second side netting 240B, and the top netting 242. The impact screen 238 being removably coupled to the first side netting 240A, the second side netting 240B, and the top netting 242 enables replacement of the impact screen 238, without replacing the entire net system 236, when the impact screen 238 wears out over repeated use. In some examples, the golf practice system 200 includes covers 296B that cover the zippers 298 along this seam.

To take down the golf practice system 200, the user can release the tension in the front suspension strap 210A and the rear suspension strap 210B via operation of the ratcheting mechanisms 234. This enables the user to decouple the intermediate strap segments 211 of the front suspension strap 210A and the rear suspension strap 210B from the corresponding end strap segments 213 via operation of (e.g., opening) the clip 290. In some examples, as shown in FIG. 11 and to help with decoupling the intermediate strap segments 211 from the end strap segments 213, the golf practice system 200 includes grab straps 295 coupled with the clips 290. The grab straps 295 hang down from the clips 290 and are long enough such that a user can grab the grab straps 295 without the use of a riser or an elevation aid (e.g., ladder or stool). Each one of the grab straps 295 is operably engaged with a corresponding one of the clips 290 such that a pull-down force applied to the grab strap 295 opens the clip 290 to decouple the intermediate strap segment 211 from the corresponding end strap segment 213 (see, e.g., a pull-strap latch, pull-tab latch, drop-strap release, etc.). In this manner, a user can decouple the intermediate strap segments 211 from the end strap segments 213 without a riser or an elevation aid.

After the intermediate strap segments 211 are decoupled from the end strap segments 213, the net system 236 and the intermediate strap segments 211 can then be stored as desired. In some examples, the net system 236 remains coupled to the hitting mat 250 when stored or, in other examples, the hitting mat 250 is removed and stored separately. Because tightening the anchor straps 292 when engaged with the intermediate strap segments 211 effectively positionally calibrates the net system 236 within the room 220, if desired, the anchor straps 292 can be kept in engagement with the intermediate strap segments 211 when taken down to make a subsequent setting up of the golf practice system 200 easier (e.g., to avoid the need to positionally recalibrate the net system 236). Accordingly, as can be recognized, unlike the golf practice system 100, the golf practice system 200 does not include an enclosure into which the net system 236 slides when taking down the golf practice system 200 or slides out of when setting up the golf practice system 200. However, the slidable nature of the net system 236 along overhead straps remains common with the golf practice system 100.

Figure 14:
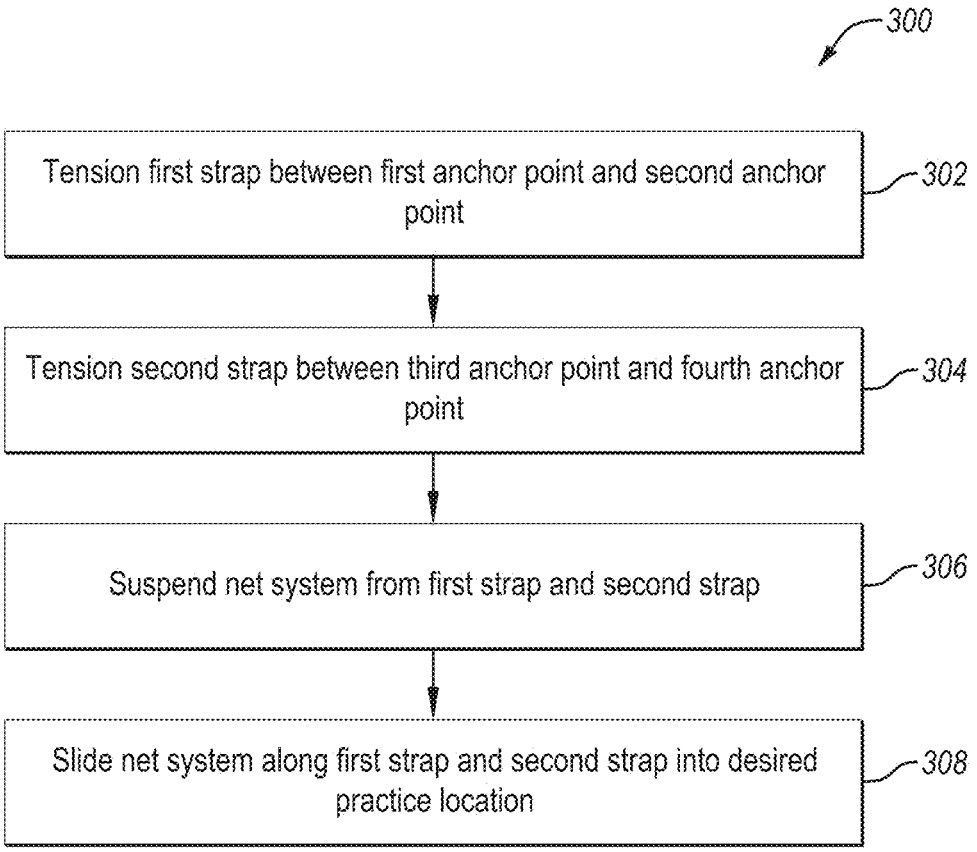
FIG. 14 is a method of using a golf practice system, according to one or more examples of the present disclosure.

Referring to FIG. 14, according to some examples, a method 300 of using a golf practice system, such as the golf practice system 100 or the golf practice system 200, includes (block 302) tensioning a first strap between a first anchor point and a second anchor point and (block 304) tensioning a second strap between a third anchor point and a fourth anchor point. When tensioned, at least a portion of the second strap is parallel to and offset from at least a portion of the first strap. The method 300 additionally includes (block 306) suspending a net system from the first strap and the second strap. The method 300 also includes (block 308) sliding the net system along the first strap and the second strap into a desired practice location. Examples of more detailed aspects of the method 300 and additional steps of the method 300 are described above.

In the above description, certain terms may be used such as "up," "down," "upper," "lower," "horizontal," "vertical," "left," "right," "over," "under" and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise. Further, the term "plurality" can be defined as "at least two." Moreover, unless otherwise noted, as defined herein a plurality of particular features does not necessarily mean every particular feature of an entire set or class of the particular features.

The term "about" or "substantially" or "approximately" in some embodiments, is defined to mean within +/−5% of a given value, however in additional embodiments any disclosure of "about" or "substantially" or "approximately" may be further narrowed and claimed to mean within +/−4% of a given value, within +/−3% of a given value, within +/−2% of a given value, within +/−1% of a given value, or the exact given value. Further, when at least two values of a variable are disclosed, such disclosure is specifically intended to include the range between the two values regardless of whether they are disclosed with respect to separate embodiments or examples, and specifically intended to include the range of at least the smaller of the two values and/or no more than the larger of the two values. Additionally, when at least three values of a variable are disclosed, such disclosure is specifically intended to include the range between any two of the values regardless of whether they are disclosed with respect to separate embodiments or examples, and specifically intended to include the range of at least the A value and/or no more than the B value, where A may be any of the disclosed values other than the largest disclosed value, and B may be any of the disclosed values other than the smallest disclosed value.

Additionally, instances in this specification where one element is "coupled" or "attached" to another element can include direct and indirect coupling or attachment. Direct coupling or attachment can be defined as one element coupled, or attached, to and in some contact with another element. Indirect coupling or attachment can be defined as coupling, or attachment, between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

The schematic flow chart diagrams included herein are generally set forth as logical flow chart diagrams. As such, the depicted order and labeled steps are indicative of one example of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

The present subject matter may be embodied in other specific forms without departing from its spirit or essential characteristics. The described examples are to be considered in all respects only as illustrative and not restrictive. All changes which come within the meaning and range of equivalency of the claims are to be embraced within their scope.

What is claimed is:

1. A golf practice system, comprising:

a first strap extendable, in tension, from a first anchor point to a second anchor point;

a second strap extendable, in tension, from a third anchor point to a fourth anchor point such that at least a portion of the second strap is parallel to and offset from at least a portion of the first strap;

a net system comprising an impact screen, a top netting, a first side netting, and a second side netting, wherein:

the impact screen is collapsible, suspendable from the first strap, and slidable along the first strap; and the top netting is collapsible, suspendable from the second strap, and slidable along the second strap.

2. The golf practice system according to claim 1, wherein:

the impact screen, the top netting, the first side netting, and the second side netting are coupled together such that the impact screen, the top netting, the first side netting, and the second side netting are co-movable relative to each other; and the impact screen and the top netting are co-slidable along the first strap and the second strap, respectively.

3. The golf practice system according to claim 1, further comprising:

a first pulley defining the first anchor point;

a second pulley defining the third anchor point;

a first ratcheting mechanism; and a second ratcheting mechanism;

wherein:

the first strap is engaged with the first pulley and the first ratcheting mechanism;

the second strap is engaged with the second pulley and the second ratcheting mechanism;

the first ratcheting mechanism is operable to tighten and loosen the first strap about the first pulley; and the second ratcheting mechanism is operable to tighten and loosen the second strap about the second pulley.

4. The golf practice system according to claim 1, further comprising anchor straps, wherein each one of the anchor straps is fixed to a corresponding portion of the net system and is selectively fixable to one of the first strap or the second strap to prevent movement of the corresponding portion of the net system to the one of the first strap or the second strap.

5. The golf practice system according to claim 1, wherein, when the impact screen is suspended from the first strap and the top netting is suspended from the second strap, the first side netting is parallel to and facing the second side netting, the top netting is perpendicular to the first side netting and the second side netting, and the impact screen is perpendicular to the first side netting, the second side netting, and the top netting.

6. The golf practice system according to claim 1, wherein:

the net system further comprises a first strap-engagement sleeve coupled to the impact screen and a second strap-engagement sleeve coupled to the top netting;

the first strap passes through and is slidable within the first strap-engagement sleeve when the impact screen is suspended from the first strap; and the second strap passes through and is slidable within the second strap-engagement sleeve when the top netting is suspended from the second strap.

7. The golf practice system according to claim 1, wherein:

the first strap comprises a first-strap intermediate strap segment, a first first-strap end strap segment selectively coupleable to the first-strap intermediate strap segment via a first-strap first clip, and a first-strap second end strap segment selectively coupleable to the first-strap intermediate strap segment via a first-strap second clip;

the first-strap first end strap segment is extendable from the first anchor point to the first-strap intermediate strap segment;

the first-strap second end strap segment is extendable from the second anchor point to the first-strap intermediate strap segment;

the first-strap intermediate strap segment is longer than the impact screen and the impact screen is suspendable from the first-strap intermediate strap segment;

the second strap comprises a second-strap intermediate strap segment, a first second-strap end strap segment selectively coupleable to the second-strap intermediate strap segment via a second-strap first clip, and a second-strap second end strap segment selectively coupleable to the second-strap intermediate strap segment via a second-strap second clip;

the second-strap first end strap segment is extendable from the third anchor point to the second-strap intermediate strap segment;

the second-strap second end strap segment is extendable from the fourth anchor point to the second-strap intermediate strap segment; and the second-strap intermediate strap segment is longer than the top netting and the top netting is suspendable from the second-strap intermediate strap segment.

8. The golf practice system according to claim 1, wherein the impact screen is removably coupled to the top netting, the first side netting, and the second side netting along a seam.

9. The golf practice system according to claim 1, further comprising a hitting mat removably coupleable to the first side netting, the second side netting, and the impact screen along a seam.

10. The golf practice system according to claim 9, wherein the net system further comprises covers that selectively cover corresponding portions of the seam.

11. The golf practice system according to claim 10, further comprising weights, wherein each one of the weights is fixed to a corresponding one of the covers.

12. The golf practice system according to claim 1, further comprising:

a first track that defines a location of the first anchor point and the third anchor point; and a second track that defines a location of the second anchor point and the fourth anchor point;

wherein:

the second track is positionable away from the first track and substantially parallel to the first track;

the first strap is extendable, in tension, from the first track to the second track; and the second strap is extendable, in tension, from the first track to the second track such that the second strap is parallel to and offset from the first strap from the first track to the second track.

13. The golf practice system according to claim 12, wherein:

a position of the first anchor point and the second anchor point along the first track is adjustable; and a position of the third anchor point and the fourth anchor point along the second track is adjustable.

14. The golf practice system according to claim 12, further comprising an enclosure, wherein:

the first track is fixed to and positioned within the enclosure;

the first strap and the second strap extend out from the enclosure; and the net system is slidable, along the first strap and the second strap, into the enclosure.

15. The golf practice system according to claim 12, further comprising:

a third track parallel to the first track and lying in a first hypothetical plane with the first track, wherein the second track and the first track lie within a second hypothetical plane perpendicular to the first hypothetical plane;

a first pulley adjustably positionable along the first track and defining the first anchor point;

a second pulley adjustably positionable along the first track and defining the third anchor point;

a first ratcheting mechanism adjustably positionable along the third track; and a second ratcheting mechanism adjustably positionable along the third track;

wherein:

the first strap is engaged with the first pulley and the first ratcheting mechanism;

the second strap is engaged with the second pulley and the second ratcheting mechanism;

the first ratcheting mechanism is operable to tighten and loosen the first strap about the first pulley; and the second ratcheting mechanism is operable to tighten and loosen the second strap about the second pulley.

16. A method of using a golf practice system, the method comprising:

tensioning a first strap between a first anchor point and a second anchor point;

tensioning a second strap between a third anchor point and a fourth anchor point so that at least a portion of the second strap is parallel to and offset from at least a portion of the first strap;

suspending a net system from the first strap and the second strap, wherein the net system comprises an impact screen, a top netting, a first side netting, and a second side netting; and sliding the net system along the first strap and the second strap into a desired practice location.

17. The method according to claim 16, further comprising anchoring the net system to the first strap and the second strap when the net system is in the desired practice location.

18. The method according to claim 16, wherein:

the first anchor point and the third anchor point are located within an enclosure such that the first strap and the second strap at least partially extend into the enclosure;

sliding the net system along the first strap and the second strap into the desired practice location comprises sliding the net system out of the enclosure in a first direction; and the method further comprises sliding the net system along the first strap and the second strap in a second direction, opposite the first direction, from the desired location into the enclosure.

19. The method according to claim 16, wherein:

the first anchor point is defined by a first coupling;

the second anchor point is defined by a second coupling;

the third anchor point is defined by a third coupling;

the fourth anchor point is defined by a fourth coupling;

the method further comprises anchoring the first coupling and the third coupling to a first side wall of a room; and the method further comprises anchoring the second coupling and the fourth coupling to a second side wall of the room that is opposite the first side wall of the room.

20. The method according to claim 19, wherein:

the first coupling comprises a first pulley;

the third coupling comprises a second pulley;

tensioning the first strap comprises ratcheting a first ratcheting mechanism to tighten the first strap about the first pulley; and tensioning the second strap comprises ratcheting a second ratcheting mechanism to tighten the second strap about the second pulley.

* * * * *